US012078064B2

(12) United States Patent
Cochain et al.

(10) Patent No.: US 12,078,064 B2
(45) Date of Patent: Sep. 3, 2024

(54) DIRECTIONAL DRILLING SYSTEMS

(71) Applicant: Schlumberger Technology Corporation, Sugar Land, TX (US)

(72) Inventors: Jeremy Cochain, Stonehouse (GB); Robert Sedgeman, Highnam (GB); Andreas Michaelides, Cheltenham (GB); Denis Li, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 56 days.

(21) Appl. No.: 17/995,493

(22) PCT Filed: Apr. 6, 2020

(86) PCT No.: PCT/US2020/026852
§ 371 (c)(1),
(2) Date: Oct. 5, 2022

(87) PCT Pub. No.: WO2021/206677
PCT Pub. Date: Oct. 14, 2021

(65) Prior Publication Data
US 2023/0175321 A1 Jun. 8, 2023

(51) Int. Cl.
*E21B 7/06* (2006.01)
*E21B 17/10* (2006.01)

(52) U.S. Cl.
CPC ..... *E21B 7/06* (2013.01); *E21B 17/1014* (2013.01)

(58) Field of Classification Search
CPC ..... E21B 7/06; E21B 17/1014
See application file for complete search history.

(56) References Cited

U.S. PATENT DOCUMENTS

| | | | | |
|---|---|---|---|---|
| 6,230,557 | B1 * | 5/2001 | Ciglenec | E21B 49/10 73/152.01 |
| 9,085,941 | B2 * | 7/2015 | Hall | E21B 10/62 |
| 9,140,067 | B2 * | 9/2015 | Crowley | E21B 7/062 |
| 9,938,814 | B2 | 4/2018 | Hay | |
| 10,633,924 | B2 * | 4/2020 | Haugvaldstad | E21B 7/06 |
| 10,830,004 | B2 * | 11/2020 | Haugvaldstad | E21B 17/1014 |
| 11,118,408 | B2 * | 9/2021 | Marshall | E21B 7/062 |
| 2015/0226009 | A1 | 8/2015 | Claudey et al. | |
| 2016/0108679 | A1 | 4/2016 | Bayliss | |
| 2016/0160567 | A1 | 6/2016 | Downton | |
| 2016/0237784 | A1 | 8/2016 | James | |
| 2018/0142520 | A1 | 5/2018 | Haugvaldstad | |
| 2022/0298910 | A1 * | 9/2022 | Kolbe | E21B 47/022 |

FOREIGN PATENT DOCUMENTS

| | | | |
|---|---|---|---|
| WO | 2018005402 | A1 | 1/2018 |
| WO | 2019005709 | A1 | 1/2019 |

OTHER PUBLICATIONS

International Search Report and Written Opinion in International Patent Application No. PCT/US2020/026852, dated Dec. 30, 2020, 8 pages.

* cited by examiner

*Primary Examiner* — Nicole Coy
(74) *Attorney, Agent, or Firm* — Jeffrey D. Frantz

(57) ABSTRACT

A directional drilling assembly includes a downhole piston and an uphole piston. A downhole piston diameter of the downhole piston is smaller than an uphole piston diameter of the uphole piston diameter. This may allow the downhole piston and/or the uphole piston to be located closer to the bit, thereby improving the maximum DLS of the system.

15 Claims, 8 Drawing Sheets

DIRECTIONAL DRILLING SYSTEMS

CROSS-REFERENCE TO RELATED APPLICATIONS

This application is a national stage entry under 35 U.S.C. 371 of International Application No. PCT/US2020/026852, filed Apr. 6, 2020.

BACKGROUND OF THE DISCLOSURE

Downhole drilling operations may use directional drilling to change the trajectory of a wellbore. A directional drilling assembly may extend pistons to contact a borehole wall. This may cause a bit to deviate from a straight-line course. By timing the piston extension, the trajectory of the wellbore may be controlled.

SUMMARY

In some embodiments, a directional drilling assembly includes a first piston having a first piston diameter and a second piston, uphole of the first piston, having a second piston diameter. The first piston diameter is different than the second piston diameter. In some embodiments, a piston support includes an outer surface that extends at a lateral angle between the first piston and the second piston. In some embodiments, a first piston area of the first piston is different than a second piston area of the second piston.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 4-1 is a representation of a longitudinal cross-sectional view of a downhole drilling assembly in a retracted position, according to at least one embodiment of the present disclosure;

FIG. 4-2 is a representation of the longitudinal cross-sectional view of the downhole drilling assembly of FIG. 4-1 in an extended position;

DETAILED DESCRIPTION

This disclosure generally relates to devices, systems, and methods for directional drilling assemblies. In some embodiments of the present disclosure, a directional drilling assembly includes an uphole piston and a downhole piston. The uphole piston may have a different diameter than the downhole piston. For example, in at least one embodiment, the downhole piston may have a smaller diameter than the uphole piston. This may allow the downhole piston and/or the uphole piston to be located closer to the bit. Moving the downhole piston and/or the uphole piston closer to the bit may improve the maximum dogleg severity (DLS) of the directional drilling assembly.

Figure 1:
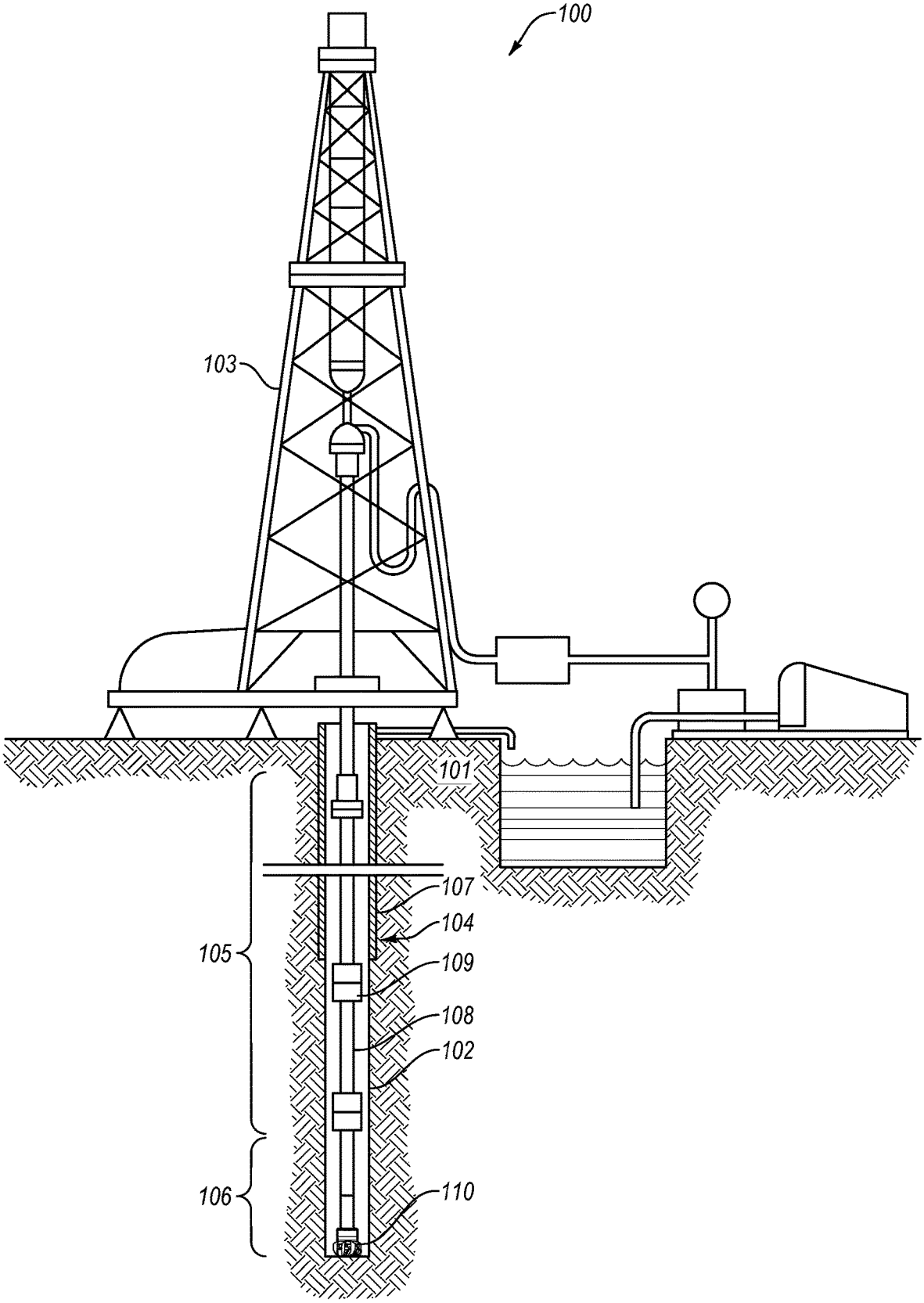
FIG. 1 is a representation of a schematic drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling (MWD) tools, logging-while-drilling (LWD) tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
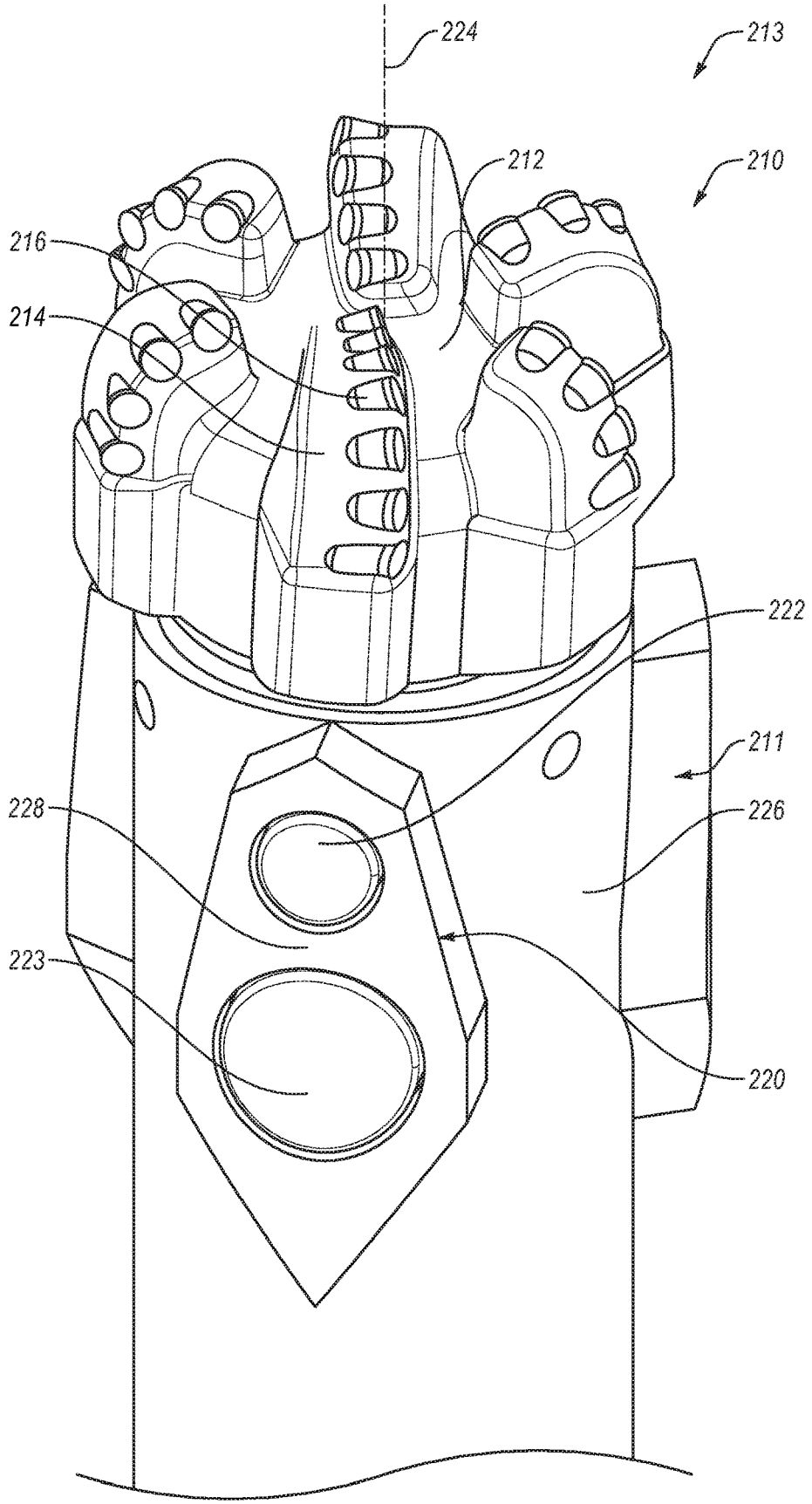
FIG. 2 is a representation of a perspective view of a directional drilling assembly, according to at least one embodiment of the present disclosure.

FIG. 2 is a perspective view of a directional drilling assembly 213, including the downhole end of an embodiment of a bit 210 and connected RSS 211. The bit 210 may include a bit body 212 from which a plurality of blades 214 may protrude. At least one of the blades 214 may have a plurality of cutting elements 216 connected thereto. In some embodiments, at least one of the cutting elements may be a planar cutting element, such as a shear cutting element. In other embodiments, at least one of the cutting elements may be a non-planar cutting element, such as a conical cutting element (e.g., STINGER™ cutting elements) or a ridged cutting element (e.g., AXE™ cutting elements).

The RSS 211 may include one or more steering devices 220. For example, in the embodiment shown, the RSS 211 includes three steering devices 220 spaced even around a circumference of the RSS 211. In some embodiments, the steering device 220 may include one or more pistons 222, 223 that are actuatable to move in a radial direction from a longitudinal axis 224 of the bit 210 and RSS 211. In other embodiments, the steering device 220 may be or include an actuatable surface or ramp that moves in a radial direction from the longitudinal axis 224. The bit 210 and RSS 211 may rotate about the longitudinal axis 224, and the one or more steering devices 220 may actuate in a timed manner with the rotation to urge the bit 210 in direction perpendicular to the longitudinal axis 224.

In the embodiment shown, the steering device 220 includes a downhole piston 222 and an uphole piston 223. The downhole piston 222 may be closer to the bit 210 than the uphole piston 223. Conventionally, the downhole piston 222 may be the same size (e.g., area, diameter) as the uphole piston 223. In some embodiments, the downhole piston 222 may be a different size than the uphole piston 223. In at least one embodiment, different sized pistons 222, 223 may allow for the downhole piston 222 and the uphole piston 223 to be located closer to the bit 210. Pistons located closer to the bit 210 may increase the maximum dogleg severity (DLS) or steering capacity of the RSS 211.

In the embodiment shown, the downhole piston 222 is smaller than the uphole piston 223. For example, the downhole piston 222 has a smaller downhole piston diameter than an uphole piston diameter of the uphole piston 223. In some examples, the downhole piston 222 has a smaller downhole piston area than an uphole piston area of the uphole piston 223. A smaller downhole piston 222 may allow the downhole piston 222 to be moved closer to the bit 210, thereby improving the steering capacity of the RSS 211.

In some embodiments, a piston support (e.g., a blade) 228 of the steering device 220 may protrude from a housing 226 of the RSS 211. In some embodiments, drilling fluid (e.g., exiting from ports in the bit) may pass by and/or impact the piston support 228. By changing the relative sizes of the downhole piston 222 and the uphole piston 223, the shape of the piston support 228 may be changed. This may allow for blade angle along the blade between the downhole piston 222 and the uphole piston. A blade angle may be more hydraulically favorable, and may help to direct fluid around the piston support 228. In some embodiments, the piston support 228 may be part of the housing 226 of the RSS 211. In some embodiments, the piston support 228 may be separate from and attached to (e.g, welded, attached with a mechanical fastener) the housing 226.

Figure 3:
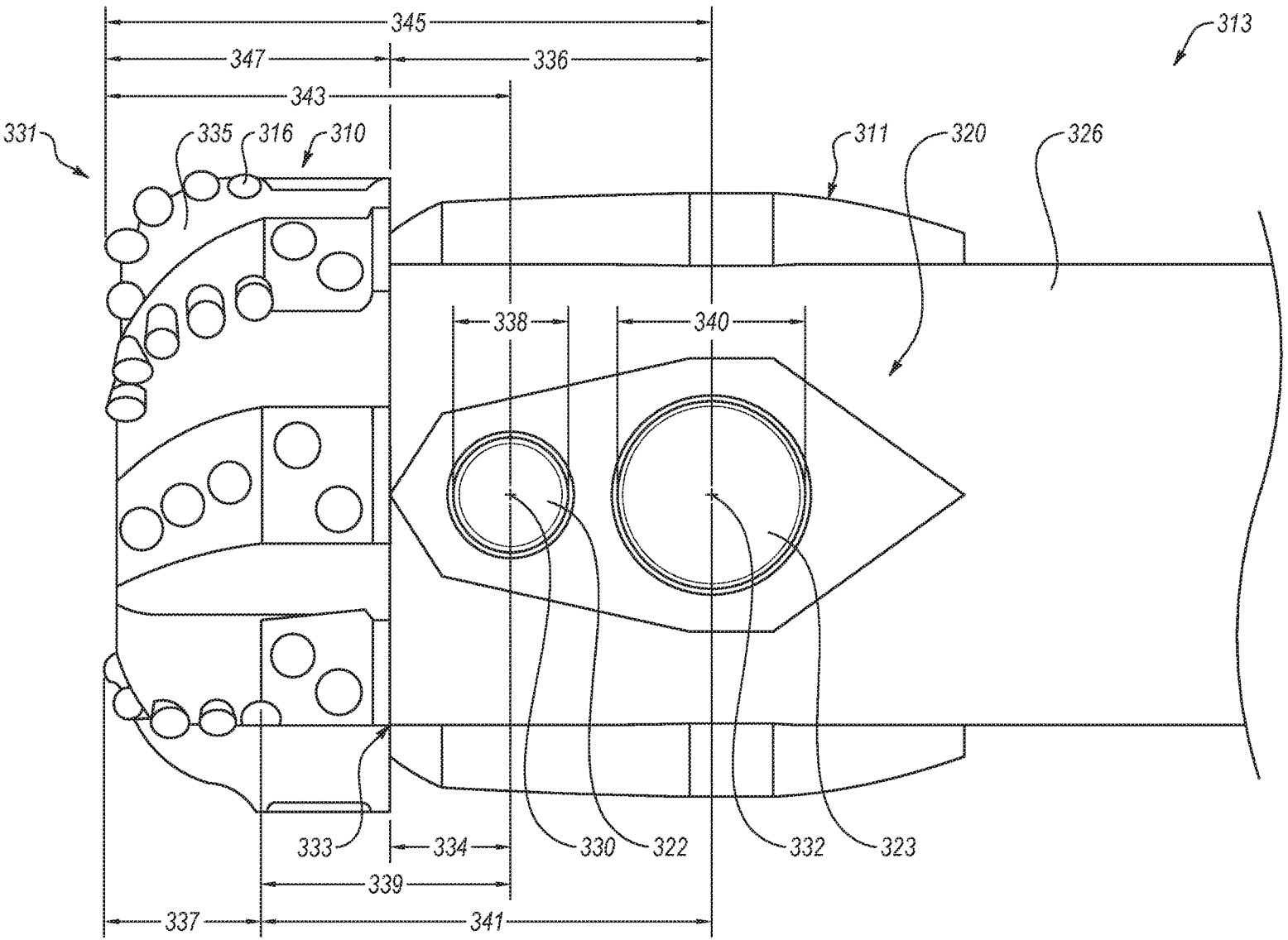
FIG. 3 is a representation of a side view of another directional drilling assembly, according to at least one embodiment of the present disclosure.

FIG. 3 is a representation of a side view of a portion of a directional drilling assembly 313, according to at least one embodiment of the present disclosure. The directional drilling assembly 313 includes an RSS 311 with one or more steering devices 320. The steering device 320 shown includes an uphole steering pad 323 and a downhole steering pad 322. The downhole steering pad 322 is extendable away from a body 326 of the RSS 311 (e.g., into the page) along a downhole extension axis 330. The uphole steering pad 323 is extendable away from the body 326 of the RSS 311 (e.g., into the page) along an uphole extension axis 332.

In some embodiments, the bit 310 extends from a downhole bit end 331 to a downhole housing end 333 of the housing 326. The bit 310 may be threaded or otherwise attached to the downhole housing end 333. The downhole extension axis 330 is located a downhole piston distance 334 away from the bit 310 (e.g., from the connection of the bit 310 to the downhole housing end 333), and the uphole extension axis 332 is located an uphole piston distance 336 away from the bit 310 (e.g., from the connection of the bit 310 to the downhole housing end 333). The bit 310 has a bit length 347, which is the distance from the downhole bit end 331 to the downhole housing end 333.

The bit 310 has a plurality of active cutting elements 316. Active cutting elements 316 may be cutting elements that actively cut the formation. In some embodiments, an active cutting element 316 may at least partially face the direction of rotation of the bit 310. The active cutting elements 316 may be located on a crown 335 of the bit 310. The crown 335 has a crown length 337, which is the length from the downhole bit end 331 to the last active cutting element 316 (e.g., the upholemost cutting element 316 on the crown 335). The downhole piston 322 is located a downhole piston crown length 339 from the last active cutting element 316 and the uphole piston is located an uphole piston crown length 341 from the last active cutting element 316. The downhole piston 322 is further located a downhole bit distance 343 from the downhole bit end 331 and the uphole piston 323 is located an uphole bit distance 345 from the downhole bit end 331.

Reducing the downhole piston distance 334 and/or the uphole piston distance 336 may improve the maximum DLS and/or steering efficacy of the RSS 311. The steering efficacy may be improved when the force applied by the downhole piston 322 and/or the uphole piston 323 is close to the bit 310. In at least one embodiment, an increased DLS may result in shorter wellbores drilled to reach a target formation or reservoir, which may decrease the cost of the wellbore.

The downhole piston 322 has a downhole piston diameter 338 and the uphole piston 323 has an uphole piston diameter 340. Conventionally, the downhole piston diameter 338 and the uphole piston diameter 340 are the same. According to embodiments of the present disclosure, the downhole piston diameter 338 is smaller than the uphole piston diameter 340. This may allow the downhole piston 322 to be moved further downhole (e.g., closer to the bit 310). In some embodiments, as the downhole piston 322 is moved downhole, the uphole piston 323 may be moved downhole. Thus, the downhole piston distance 334 and the uphole piston distance 336 may be reduced, which may increase the maximum DLS and/or the steering efficacy of the RSS 311. In some embodiments, the uphole piston diameter 340 may be larger than the downhole piston diameter.

In some embodiments, the downhole piston distance 334 may be in a range having an upper value, a lower value, or upper and lower values including any of 2 cm, 3 cm, 4 cm, 5 cm, 7.5 cm, 10 cm, 15 cm, 20 cm, 25 cm, 30 cm, 35 cm, 40 cm, or any value therebetween. For example, the downhole piston distance 334 may be greater than 2 cm. In another example, the downhole piston distance 334 may be less than 40 cm. In yet other examples, the downhole piston distance 334 may be any value in a range between 2 cm and 40 cm. In some embodiments, it may be critical that the downhole piston distance 334 is less than 7.5 cm to increase the maximum DLS.

In some embodiments, the downhole piston distance 334 may be a downhole distance percentage of the downhole piston diameter 338 (e.g., downhole piston distance 334 divided by the downhole piston diameter 338). In some embodiments, the downhole distance percentage may be in a range having an upper value, a lower value, or upper and lower values including any of 80%, 90%, 100%, 105%, 110%, 120%, 130%, 140%, 150%, 160%, or any value therebetween. For example, the downhole distance percentage may be greater than 80%. In another example, the downhole distance percentage may be less than 160%. In yet other examples, the downhole distance percentage may be any value in a range between 80% and 160%. In some embodiments, it may be critical that the downhole distance percentage is less than 120% to increase the maximum DLS.

In some embodiments, the downhole crown length 339 may be in a range having an upper value, a lower value, or upper and lower values including any of 2 cm, 3 cm, 4 cm, 5 cm, 7.5 cm, 10 cm, 15 cm, 20 cm, 25 cm, 30 cm, 35 cm, 40 cm, or any value therebetween. For example, the downhole crown length 339 may be greater than 2 cm. In another example, the downhole crown length 339 may be less than 40 cm. In yet other examples, the downhole piston distance 334 may be any value in a range between 2 cm and 40 cm. In some embodiments, it may be critical that the downhole crown length 339 is less than 20 cm to increase the maximum DLS.

In some embodiments, the downhole piston 322 may be a downhole crown percentage from the last active cutting element 316 (e.g., the crown length 337 divided by the downhole piston crown distance 339. In some embodiments, the downhole crown percentage may be in a range having an upper value, a lower value, or upper and lower values including any of 10%, 20%, 30%, 40%, 50%, 60%, 70%, 80%, 90%, 100%, 110%, 120%, 130%, 140%, 150%, 160%, 170%, 180%, 190%, 200%, 250%, 300%, 400%, 500%, or any value therebetween. For example, the downhole crown percentage may be greater than 10%. In another example, the downhole crown percentage may be less than 500%. In yet other examples, the downhole crown percentage may be any value in a range between 10% and 500%. In some embodiments, it may be critical that the downhole crown percentage is greater than 100% to increase the maximum DLS.

In some embodiments, the downhole piston 322 may be a downhole bit length percentage from the downhole bit end 331 (e.g., the bit length 347 divided by the downhole bit distance 343). In some embodiments, the downhole bit length percentage may be in a range having an upper value, a lower value, or upper and lower values including any of 10%, 20%, 30%, 40%, 50%, 60%, 70%, 75%, 80%, 85%, 90%, 95%, or any value therebetween. For example, the downhole bit length percentage may be greater than 10%. In another example, the downhole bit length percentage may be less than 90%. In yet other examples, the downhole bit length percentage may be any value in a range between 10% and 95%. In some embodiments, it may be critical that the downhole bit length percentage is greater than 75% to increase the maximum DLS.

In some embodiments, the uphole piston distance 336 may be in a range having an upper value, a lower value, or upper and lower values including any of 5 cm, 10 cm, 15 cm, 20 cm, 25 cm, 30 cm, 35 cm, 40 cm, 50 cm, or any value therebetween. For example, the uphole piston distance 336 may be greater than 5 cm. In another example, the uphole piston distance 336 may be less than 50 cm. In yet other examples, the uphole piston distance 336 may be any value in a range between 5 cm and 50 cm. In some embodiments, it may be critical that the uphole piston distance 336 is less than 30 cm to increase the maximum DLS.

In some embodiments, the uphole piston distance 336 may be an uphole distance percentage of the uphole piston diameter 340 (e.g., uphole piston distance 336 divided by the uphole piston diameter 340). In some embodiments, the uphole distance percentage may be in a range having an upper value, a lower value, or upper and lower values including any of 50%, 100%, 105%, 110%, 120%, 130%, 140%, 150%, 160%, 170%, 180%, 190%, 200%, 250%, 500% or any value therebetween. For example, the uphole distance percentage may be greater than 50%. In another example, the uphole distance percentage may be less than 500%. In yet other examples, the uphole distance percentage may be any value in a range between 50% and 500%. In some embodiments, it may be critical that the uphole distance percentage is less than 200% to increase the maximum DLS.

In some embodiments, the uphole crown length 341 may be in a range having an upper value, a lower value, or upper and lower values including any of 10 cm, 15 cm, 20 cm, 25 cm, 30 cm, 50 cm, or any value therebetween. For example, the uphole crown length 341 may be greater than 10 cm. In another example, the uphole crown length 341 may be less than 50 cm. In yet other examples, the uphole crown length 341 may be any value in a range between 10 cm and 50 cm. In some embodiments, it may be critical that the uphole crown length 341 is less than 20 cm to increase the maximum DLS.

In some embodiments, the uphole piston 323 may be an uphole crown percentage from the last active cutting element 316 (e.g., the crown length 337 divided by the uphole piston crown distance 341. In some embodiments, the uphole crown percentage may be in a range having an upper value, a lower value, or upper and lower values including any of 10%, 20%, 30%, 40%, 50%, 60%, 70%, 80%, 90%, 100%, 110%, 120%, 130%, 140%, 150%, 160%, 170%, 180%, 190%, 200%, 250%, 300%, 400%, 500%, or any value therebetween. For example, the uphole crown percentage may be greater than 10%. In another example, the uphole crown percentage may be less than 500%. In yet other examples, the uphole crown percentage may be any value in a range between 10% and 500%. In some embodiments, it may be critical that the uphole crown percentage is greater than 150% to increase the maximum DLS.

In some embodiments, the uphole piston 323 may be an uphole bit length percentage from the downhole bit end 331 (e.g., the bit length 347 divided by the uphole bit distance 345). In some embodiments, the uphole bit length percentage may be in a range having an upper value, a lower value, or upper and lower values including any of 10%, 20%, 30%, 40%, 50%, 60%, 70%, 75%, 80%, 85%, 90%, 95%, or any value therebetween. For example, the uphole bit length percentage may be greater than 10%. In another example, the uphole bit length percentage may be less than 90%. In yet other examples, the uphole bit length percentage may be any value in a range between 10% and 95%. In some embodiments, it may be critical that the uphole bit length percentage is greater than 75% to increase the maximum DLS.

In some embodiments, the downhole piston diameter 338 may be in a range having an upper value, a lower value, or upper and lower values including any of 1 cm, 2 cm, 2.5 cm, 3 cm, 3.5 cm, 4 cm, 4.5 cm, 5 cm, 6 cm, 8 cm, 10 cm, 12 cm, or any value therebetween. For example, the downhole piston diameter 338 may be greater than 1 cm. In another example, the downhole piston diameter 338 may be less than 10 cm. In yet other examples, the downhole piston diameter 338 may be any value in a range between 1 cm and 10 cm. In some embodiments, it may be critical that the downhole piston diameter 338 is less than 4 cm to move the downhole piston 322 closer to the bit 310 and improve the DLS.

In some embodiments, the uphole piston diameter 340 may be in a range having an upper value, a lower value, or upper and lower values including any of 3 cm, 4 cm, 5, cm, 6 cm, 6.5 cm, 7 cm, 7.5 cm, 8 cm, 10 cm, 12 cm, or 16 cm or any value therebetween. For example, the uphole piston diameter 340 may be greater than 4 cm. In another example, the uphole piston diameter 340 may be less than 16 cm. In yet other examples, the uphole piston diameter 340 may be any value in a range between 4 cm and 12 cm. In some embodiments, it may be critical that the uphole piston diameter 340 is greater than 5 cm to provide sufficient force for directional drilling.

The downhole piston 322 and the uphole piston 323 have a diameter percentage, which may be the downhole piston diameter 338 divided by the uphole piston diameter 340. In some embodiments, the diameter percentage may be in a range having an upper value, a lower value, or upper and lower values including any of 20%, 25%, 30%, 35%, 40%, 45%, 50%, 55%, 60%, 65%, 70%, 75%, 80%, 85%, 90%, 95%, 100%, or any value therebetween. For example, the diameter percentage may be greater than 20%. In another example, the diameter percentage may be less than 100%. In yet other examples, the diameter percentage may be any value in a range between 20% and 100%. In some embodiments, it may be critical that the diameter percentage is less than 50% to move the downhole piston 322 close to the bit 310 and improve the DLS. In some embodiments, it may be critical that the diameter percentage is less than 75% to move the downhole piston 322 close to the bit 310 and improve the DLS.

The downhole piston 322 has a downhole piston area. In some embodiments, the downhole piston area may be in a range having an upper value, a lower value, or upper and lower values including any 3.1 $cm^2$, 13 $cm^2$, 20 $cm^2$, 28 $cm^2$, 38 $cm^2$, 50 $cm^2$, 64 $cm^2$, 79 $cm^2$, 154 $cm^2$, or any value therebetween. For example, the downhole piston area may be greater than 3.1 $cm^2$. In another example, the downhole piston area may be less than 79 $cm^2$. In yet other examples, the downhole piston area may be any value in a range between 3.1 $cm^2$ and 79 $cm^2$. In some embodiments, it may be critical that the downhole piston area is less than 28 $cm^2$ to move the downhole piston 322 closer to the bit 310 and improve the DLS.

The uphole piston 323 has an uphole piston area. In some embodiments, the uphole piston area may be in a range having an upper value, a lower value, or upper and lower values including any of 20 $cm^2$, 28 $cm^2$, 50 $cm^2$, 79 $cm^2$, 95 $cm^2$, 113 $cm^2$, 133 $cm^2$, 154 $cm^2$, 201 $cm^2$, 314 $cm^2$, or any value therebetween. For example, the uphole piston area may be greater than 28 $cm^2$. In another example, the downhole piston area may be less than 201 $cm^2$. In yet other examples, the uphole piston area may be any value in a range between 50 $cm^2$ and 314 $cm^2$. In some embodiments, it may be critical that the uphole piston area is greater than 50 $cm^2$ to provide sufficient force for directional drilling.

The downhole piston 322 and the uphole piston 323 have an area percentage, which may be the downhole piston area divided by the uphole piston area. In some embodiments, the area percentage may be in a range having an upper value, a lower value, or upper and lower values including any of 5%, 10%, 25%, 30%, 35%, 40%, 45%, 50%, 60%, 70%, 75%, 80%, 90%, 100%, or any value therebetween. For example, the area percentage may be greater than 5%. In another example, the diameter percentage may be less than 100%. In yet other examples, the diameter percentage may be any value in a range between 5% and 100%. In some embodiments, it may be critical that the diameter percentage is less than 50% to move the uphole piston 323 and the downhole piston 322 close to the bit 310 and improve DLS.

In the embodiment shown, the downhole extension axis 330 is longitudinally aligned with the uphole extension axis 332. In some embodiments, the downhole extension axis 330 may not be longitudinally aligned with the uphole extension axis 332. For example, the downhole extension axis 330 may be located rotationally ahead of (e.g., lead) the uphole extension axis 332. In some examples, the downhole extension axis 330 may be located rotationally behind (e.g., trail) the uphole extension axis 332.

Figures 1, 4:
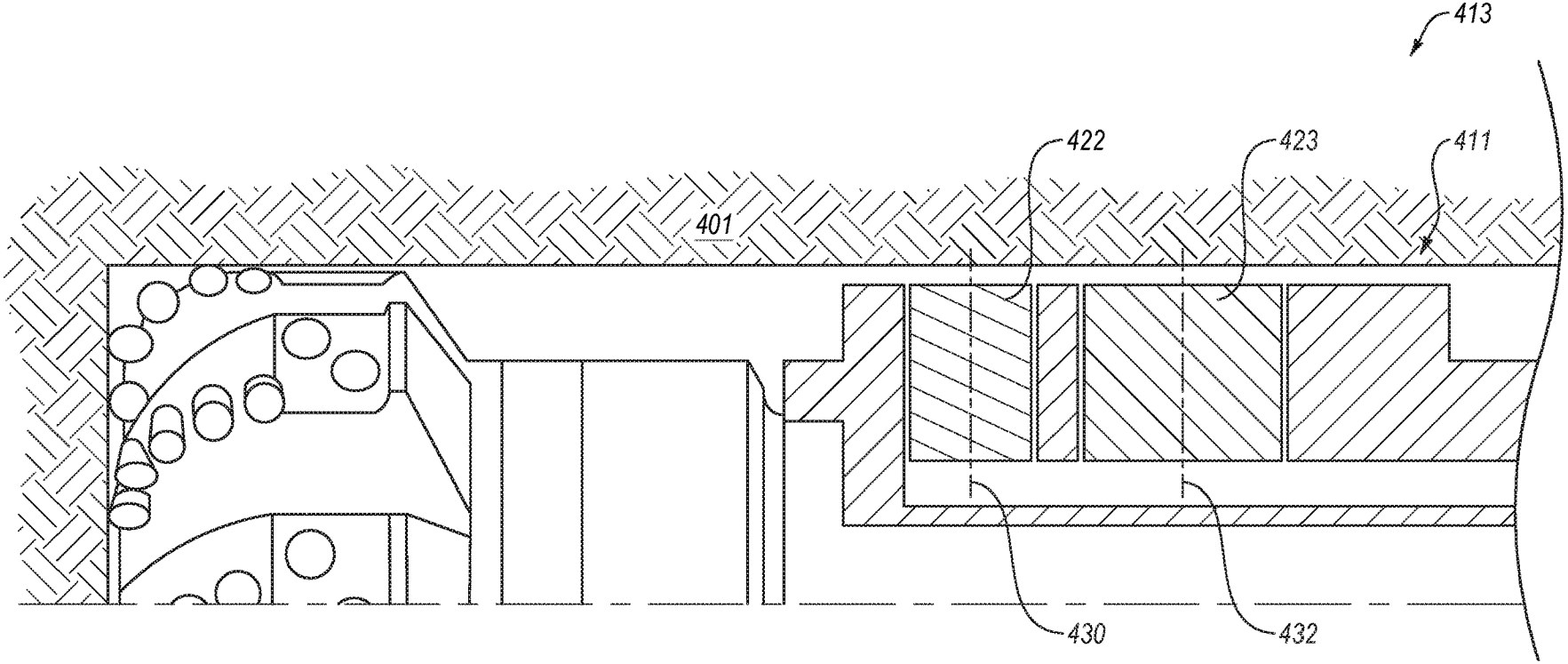
Figures 2, 4:
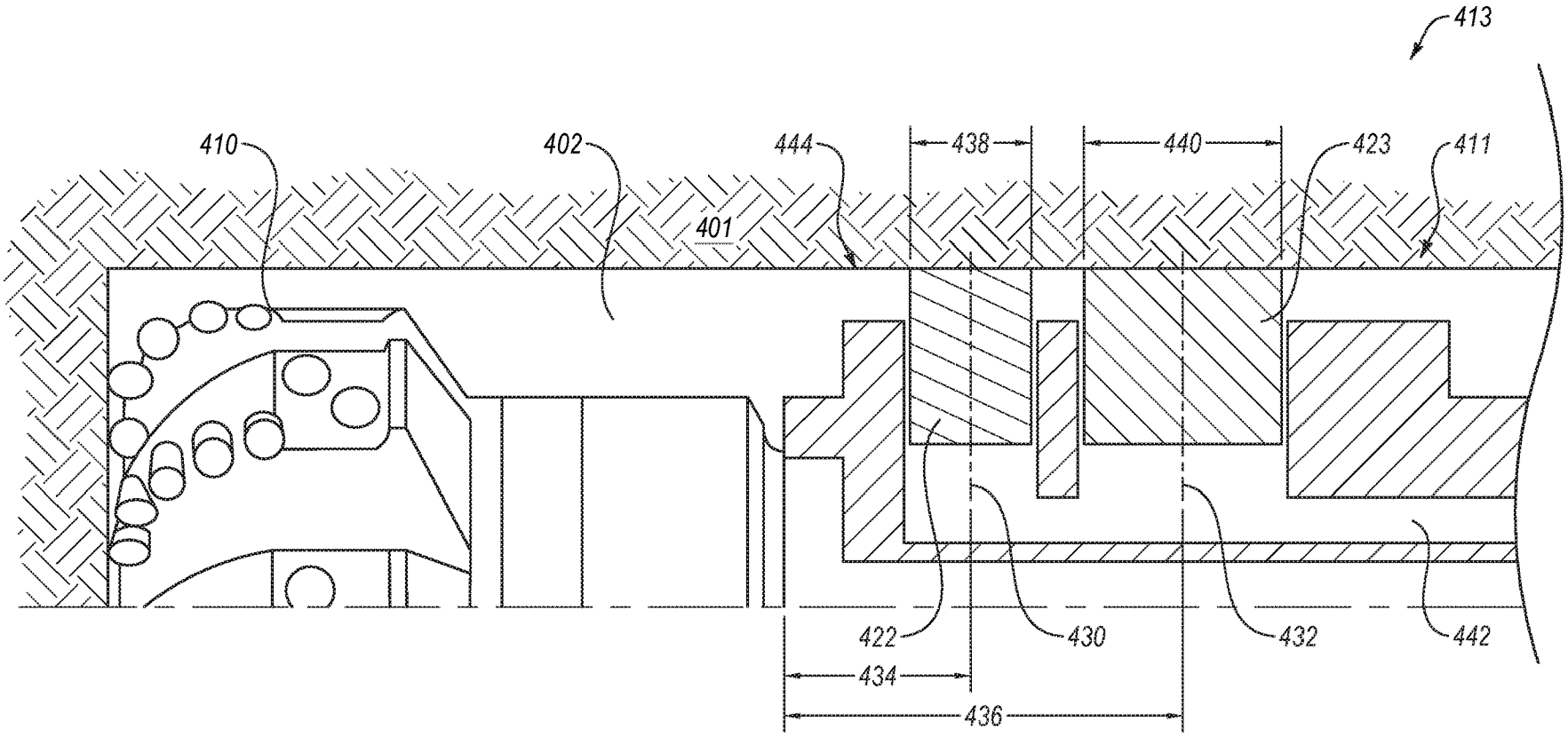

FIG. 4-1 is a representation of a cross-sectional view of a directional drilling assembly 413, according to at least one embodiment of the present disclosure. In the view shown, an RSS 411 includes a downhole piston 422 and an uphole piston 423 in a retracted position. The downhole piston 422 extends outward toward a formation 401 along a downhole extension axis 430 and the uphole piston 423 extends outward toward the formation 401 along an uphole extension axis 432.

FIG. 4-2 is a representation of the directional drilling assembly 413 of FIG. 4-1 with the downhole piston 422 and the uphole piston 423 in an extended position. Fluid is passed through a fluid pathway 442 and contacts the downhole piston 422 and the uphole piston 423. Fluid pressure from the fluid causes the downhole piston 422 to extend outward with a downhole extension pressure and the uphole piston 423 to extend outward with an uphole extension pressure until they contact a borehole wall 444 of the formation 401. In some embodiments, the downhole extension pressure is the same as the uphole extension pressure because the fluid pressure acting on the downhole piston 422 is the same on the uphole piston 423. The force of the pistons against the wellbore wall 444 may push the bit 410 away from the borehole wall 444, thereby causing the wellbore 402 to change trajectory (e.g., causes a dogleg in the wellbore). The amount of change in trajectory of the wellbore 402 is the dogleg severity (DLS). Increasing the force applied to the wellbore wall 444 by the downhole piston 422 and/or the uphole piston 423 may increase the DLS. Furthermore, decreasing the downhole piston distance 434 between the bit 410 and the downhole extension axis 430 and/or the uphole piston distance 436 between the bit 410 and the uphole extension axis 432 may increase the DLS.

As may be seen, the downhole piston 422 has a downhole piston diameter 438 that is smaller than an uphole piston diameter 440 of the uphole piston. Reducing the diameter of the downhole piston 422 may allow the downhole piston 422 to be moved closer to the bit 410, thereby increasing the maximum DLS. Furthermore, reducing the diameter of the downhole piston 422 may allow the uphole piston 423 to be moved closer to the bit 410, thereby increasing the maximum DLS.

Conventional RSSs have a combined area, which is the combined surface area of the uphole piston and the downhole piston. The combined area provides a combined steering force against the wellbore wall, based on the fluid force of the actuating fluid. By reducing the diameter (and area) of the downhole piston 422, the combined steering force of the downhole piston and the uphole steering piston may be reduced. Nevertheless, by reducing the diameter of the downhole piston 422, the downhole piston and/or the uphole piston 423 may be moved closer to the bit 410. This may increase the steering effectiveness of the downhole piston 422 and/or the uphole piston 423. In some embodiments, the decrease in steering force may be offset by the increase in steering effectiveness by moving the downhole piston and/or the uphole piston 423 closer to the bit 410.

In some embodiments, the uphole piston 423 may be smaller than the downhole piston 422. In some embodiments, the downhole piston 422 may be smaller than the uphole piston 423. In some embodiments, to maintain the combined steering force, the uphole piston 423 may be increased in diameter. This may increase the uphole piston area, thereby increasing the total steering force. In some embodiments, the combined area of the downhole piston 422 and the uphole piston 423 may not change as the downhole piston diameter 438 is reduced and the uphole piston diameter 440 is increased. Furthermore, as the downhole piston diameter 438 is reduced, to maintain the same combined area, the uphole piston area is increased. However, because area increases with the square of the radius, then the uphole piston diameter 440 may be increased by a smaller amount than the downhole piston diameter 438 is decreased. In this manner, the uphole piston 423 may be moved closer to the bit 410, even if the uphole piston diameter 440 is increased.

In some embodiments, the combined area may be increased. In some embodiments the combined area may be decreased.

Figure 5:
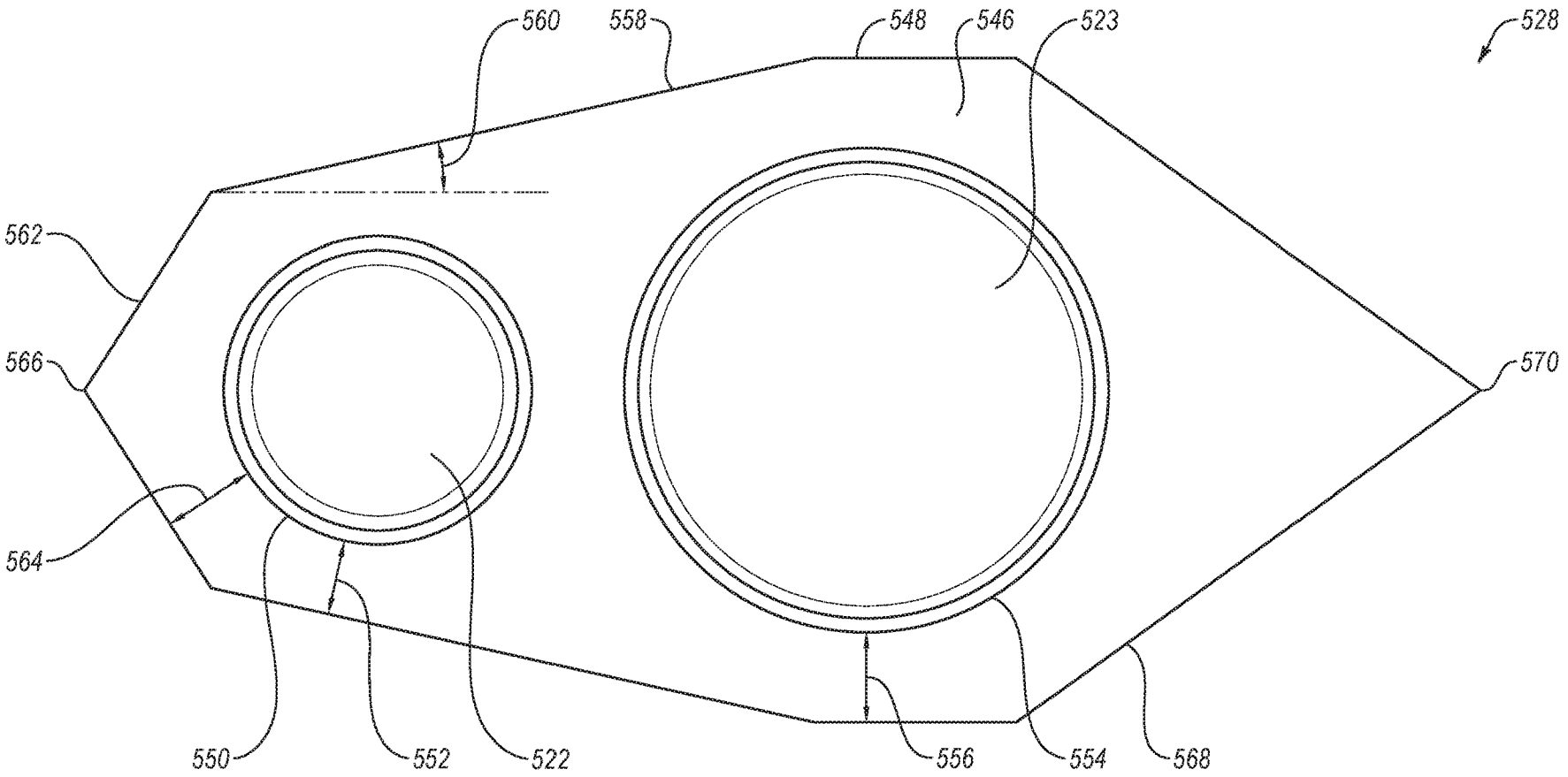
FIG. 5 is a representation of a piston support, according to at least one embodiment of the present disclosure.

FIG. 5 is a representation of a piston support 528 (e.g., a blade) supporting a downhole piston 522 and an uphole piston 523, according to at least one embodiment of the present disclosure. The piston support 528 includes a support body 546 having an outer surface 548 extending around a perimeter of the piston support 528. The outer surface 548 is offset from a downhole outer edge 550 of the downhole piston 522 with a downhole edge offset 552. The outer surface 548 is offset from an uphole outer edge 554 with an uphole edge offset 556. The downhole edge offset 552 and the uphole edge offset 556 help protect the pistons and the piston openings from damage caused during downhole drilling.

In some embodiments, the downhole edge offset 552 is the same as the uphole edge offset 556. In some embodiments, the downhole edge offset 552 is less than the uphole edge offset 556 because the downhole piston diameter (e.g., downhole piston diameter 338 of FIG. 3) is smaller than the uphole piston diameter (e.g., uphole piston diameter 340 of FIG. 3). In some embodiments, the profile of the outer surface 548 may change based on the size of the downhole piston 522 and/or the uphole piston 523. If the downhole piston 522 and the uphole piston 523 are the same size, then a longitudinal edge 558 of the piston support 528 may be parallel to the longitudinal axis (e.g., longitudinal axis 224 of FIG. 2).

In some embodiments, the longitudinal edge 558 may form a lateral angle 560 that is non-parallel (e.g., transverse) to the longitudinal axis. The lateral angle 560 may be based on the diameter difference in downhole piston diameter to uphole piston diameter. Thus, a larger diameter difference may result in a larger lateral angle 560 and a smaller diameter difference may result in a smaller lateral angle 560. In some embodiments, the lateral edge may extend uphole and circumferentially away from the downhole piston 522 (e.g., toward the uphole piston 523). In some embodiments, a lateral angle 560 may cause the piston support 528 to be more hydrodynamic. In other words, as fluid flows from the bit and across the support body 546, the fluid may be directed away from the support body 546. This may reduce eddy currents in the flow and reduce cutting buildup at the downhole piston 522 and/or uphole piston 523.

In some embodiments, the lateral angle 560 may be in a range having an upper value, a lower value, or upper and lower values including any of 0.5°, 1°, 1.5°, 2.0°, 3°, 4°, 5°, 7.5°, 10°, 15°, 20°, 25°, 30°, 35°, 40°, 45°, or any value therebetween. For example, the lateral angle 560 may be greater than 0.5°. In another example, the lateral angle 560 may be less than 45°. In yet other examples, the lateral angle 560 may be any value in a range between 0.5° and 45°. In some embodiments, it may be critical that the lateral angle 560 is greater than 5° to direct fluid away from the downhole pad 522.

The outer surface 548 of the piston support 528 includes a leading edge 562 that is offset from the downhole piston 522 with a leading edge offset 564. The leading edge offset 564 may help to determine the downhole piston distance (e.g., downhole piston distance 334 of FIG. 3). In some embodiments, the leading edge offset 564 may be the same as the downhole edge offset 552. In some embodiments, the leading edge offset 564 may be reduced as the downhole piston diameter is reduced. This may allow the downhole piston 522 to be moved closer to the bit, thereby increasing the maximum DLS.

In the embodiment shown, the leading edge 562 may terminate at a point 566. Terminating the leading edge 562 at a point 566 may be hydrodynamically favorable and may help to divert fluid and cutting around the support body 546 of the piston support 528. In some embodiments, the point may abut or be adjacent to the bit. This may place the downhole piston 522 as close to the bit as possible. In some embodiments, the point 566 may be aligned with the longitudinal axis of the bit, the first extension axis (e.g., first extension axis 330 of FIG. 3) and the second extension axis (e.g., second extension axis 332 of FIG. 3).

In the embodiment shown, a trailing edge 568 extends uphole of the uphole piston 523 and terminates at an uphole point 570. The length of the trailing edge 568 may be sized to reduce turbulence of the drilling fluid as it passes by the uphole piston 523.

Figure 6:
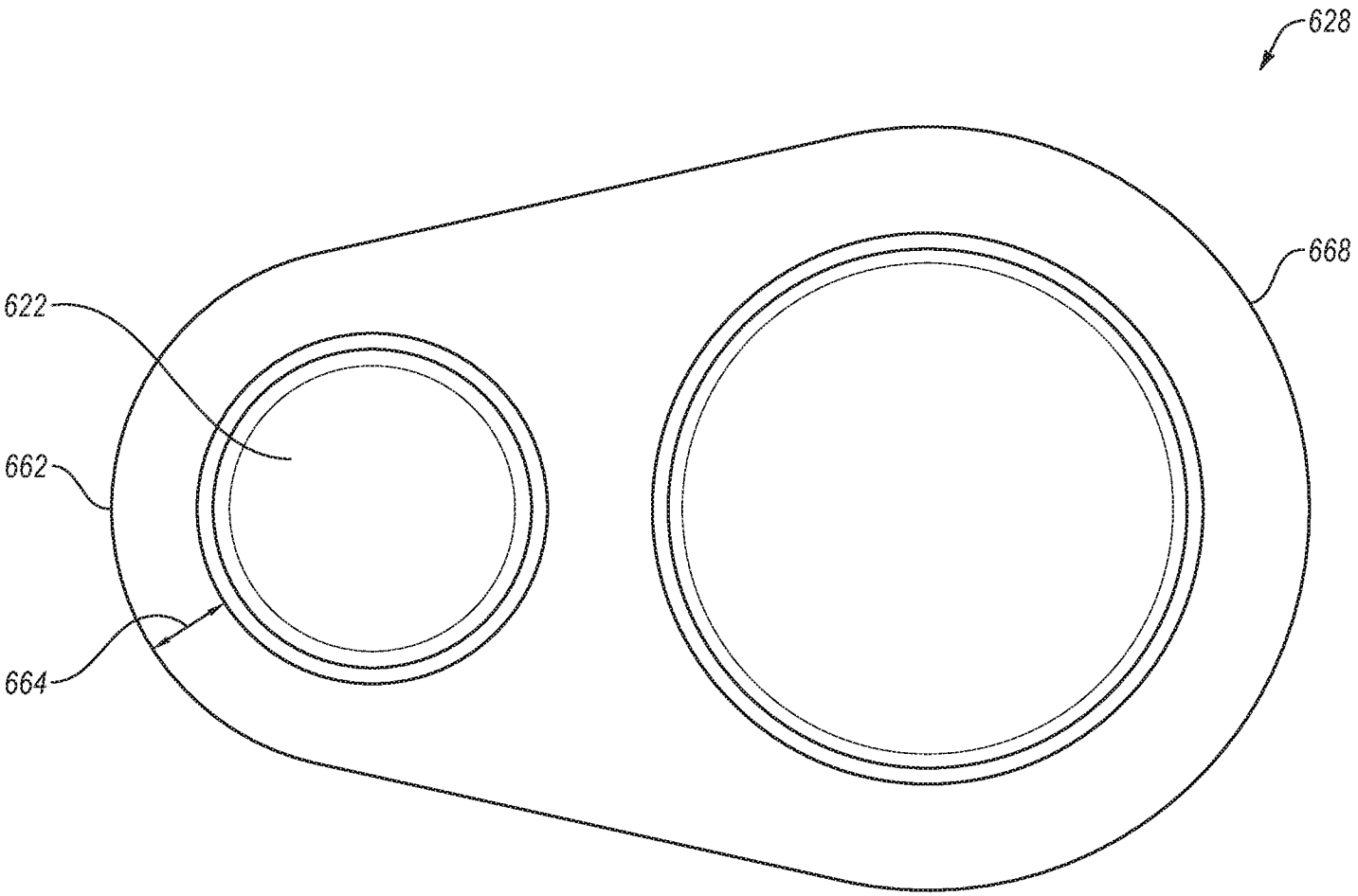
FIG. 6 is a representation of another piston support, according to at least one embodiment of the present disclosure.

FIG. 6 is a representation of an embodiment of a piston support 628 having a rounded leading edge 662, according to at least one embodiment of the present disclosure. The rounded leading edge 662 may have a constant leading edge offset 664. This may allow the downhole piston 622 to be moved closer to the bit, thereby improving the maximum DLS. Furthermore, a rounded leading edge 662 may be hydrodynamically favorable, allowing drilling fluid to flow around the piston support 628 and the downhole piston 622. In some embodiments, the trailing edge 668 may be rounded.

Figure 7:
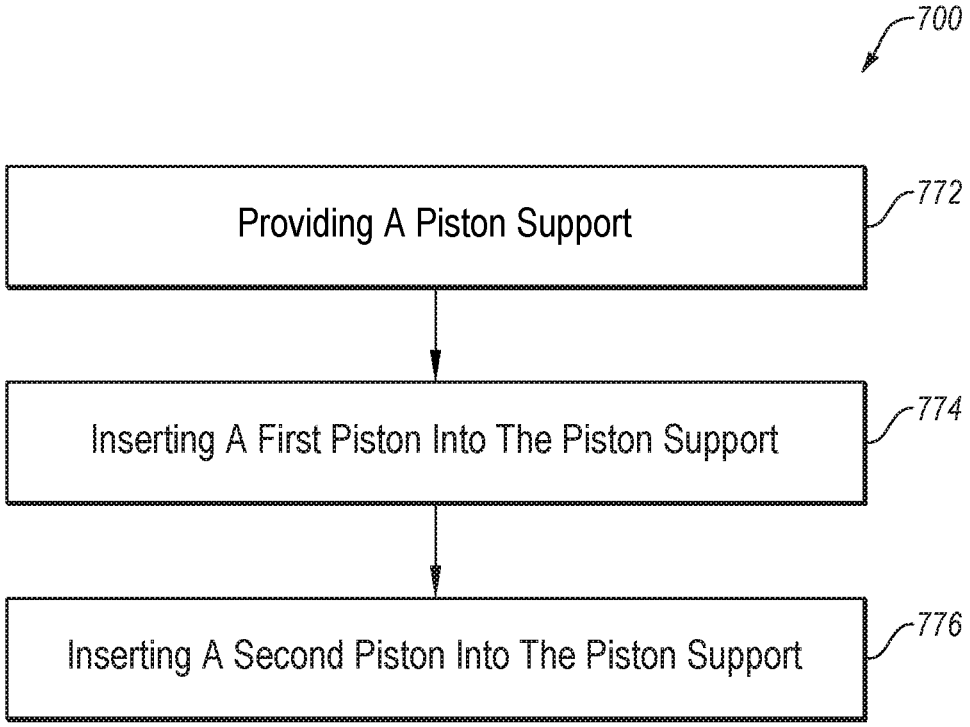
FIG. 7 is a representation of a method for manufacturing a directional drilling assembly, according to at least one embodiment of the present disclosure.

FIG. 7 is a representation of a method 700 for assembling a directional drilling assembly, according to at least one embodiment of the present disclosure. The method 700 includes providing a piston support at 772. The piston support may include a piston support body with a downhole opening for a downhole piston and an uphole opening for an uphole piston. The method 700 further includes inserting a first (e.g., downhole) piston into the piston support at 774. The downhole piston has a downhole piston diameter. A second (e.g., uphole) piston having an uphole piston diameter may be inserted into the piston support at 776. The downhole piston diameter may be smaller than the uphole piston diameter. In some embodiments, the downhole piston may be smaller than the uphole piston diameter to place the downhole piston closer to the bit.

The embodiments of the directional drilling systems have been primarily described with reference to wellbore drilling operations; the directional drilling systems described herein may be used in applications other than the drilling of a wellbore. In other embodiments, directional drilling systems according to the present disclosure may be used outside a wellbore or other downhole environment used for the exploration or production of natural resources. For instance, directional drilling systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A directional drilling assembly to aid steering of a bit, comprising:

a piston support comprising a first opening, a second opening located uphole of the first opening, a longitudinal axis, and an outer surface including a leading edge and a trailing edge, wherein the leading edge terminates at a first point, the trailing edge terminates at a second point, and the longitudinal axis passes through the first point, the second point, the first opening, and the second opening;

a first piston disposed in the first opening and comprising a first piston area, wherein the first piston is extendible transversely to the longitudinal axis to steer the bit; and a second piston disposed in the second opening and comprising a second piston area, wherein the second piston is extendible transversely to the longitudinal axis to steer the bit, and wherein the first piston area is smaller than the second piston area.

2. The directional drilling assembly of claim 1, wherein the first piston area is 75% or less than the second piston area.

3. The directional drilling assembly of claim 1, wherein the first piston area is 50% or less than the second piston area.

4. A directional drilling assembly, comprising:

a piston support including an outer surface having a leading edge;

a first piston extending through the piston support, wherein the outer surface is offset from a first perimeter of the first piston by a first edge offset, wherein the leading edge is offset from the first perimeter by a leading edge offset, and wherein the first edge offset and the leading edge offset are the same; and a second piston located uphole of the first piston and extending through the piston support, wherein the outer surface is offset from a second perimeter of the second piston by a second edge offset, and wherein the first edge offset is less than the second edge offset, wherein the outer surface of the piston support extends at a lateral angle between the first piston and the second piston.

5. The directional drilling assembly of claim 4, wherein a longitudinal edge of the outer surface extends uphole and away from a first piston extension axis.

6. The directional drilling assembly of claim 4, wherein the first piston has a first piston diameter, the second piston has a second piston diameter, and wherein the first piston diameter is smaller than the second piston diameter.

7. The directional drilling assembly of claim 6, wherein a diameter percentage between the first piston and the second piston being less than 50%.

8. The directional drilling assembly of claim 4, wherein the leading edge terminates at a point.

9. The directional drilling assembly of claim 8, wherein the point is longitudinally aligned with a first extension axis of the first piston.

10. A directional drilling assembly, comprising:

a bit rotatable about a longitudinal axis, the bit including a plurality of cutting elements, and a last active cutting element of the plurality of cutting elements being an upholemost active cutting element;

a directional drilling assembly coupled to the bit, the directional drilling assembly comprising:

a piston support comprising an outer surface and a first leading edge;

a first piston disposed in the piston support and configured to extend transversely relative to the longitudinal axis, the first piston having a first piston diameter and first perimeter, the outer surface being offset from the first perimeter by a first edge offset, the leading edge being offset from the first perimeter by a leading edge offset, and the first edge offset and the leading edge offset being the same; and a second piston disposed in the piston support and located uphole of the first piston, the second piston being configured to extend transversely relative to the longitudinal axis, the second piston having a second piston diameter and second perimeter, the outer surface being offset from the second perimeter by a second edge offset, and the first edge offset being less than the second edge offset.

11. The directional drilling assembly of claim 10, wherein the first piston diameter is 75% or less than the second piston diameter.

12. The directional drilling assembly of claim 11, wherein the first piston diameter is 60% or less than the second piston diameter.

13. The directional drilling assembly of claim 10, wherein a first piston area of the first piston is 50% or less than a second piston area of the second piston.

14. The directional drilling assembly of claim 10, wherein a first piston area of the first piston is 75% or less than a second piston area of the second piston.

15. The directional drilling assembly of claim 10, wherein the first piston extends with a first extension pressure and the second piston extends with a second extension pressure, the first extension pressure being the same as the second extension pressure.

* * * * *